US007252183B2

(12) United States Patent
Christie

(10) Patent No.: US 7,252,183 B2
(45) Date of Patent: Aug. 7, 2007

(54) ARTICLE OF MANUFACTURE WITH QUICK ACCESS FEATURE

(76) Inventor: Thai Christie, 10929 Park Rd., Fairfax, VA (US) 22030

( * ) Notice: Subject to any disclaimer, the term of this patent is extended or adjusted under 35 U.S.C. 154(b) by 391 days.

(21) Appl. No.: 10/891,049

(22) Filed: Jul. 15, 2004

(65) Prior Publication Data

US 2005/0029065 A1 Feb. 10, 2005

Related U.S. Application Data

(63) Continuation-in-part of application No. 10/391,958, filed on Mar. 19, 2003, now abandoned.

(60) Provisional application No. 60/406,381, filed on Aug. 28, 2002.

(51) Int. Cl.
*A45C 5/12* (2006.01)
*A45C 13/00* (2006.01)

(52) U.S. Cl. ..... 190/102; 190/36; 190/109; 206/576; 206/583; 383/117

(58) Field of Classification Search ..... 150/117; 190/102, 109, 111, 36, 103–105, 108, 902; 206/0.81, 576, 39.5, 38.1, 37.2, 38, 583; 383/2, 117
See application file for complete search history.

(56) References Cited

U.S. PATENT DOCUMENTS

| | | | | | |
|---|---|---|---|---|---|
| 341,898 | A | * | 5/1886 | Ford | 150/117 |
| 1,236,247 | A | * | 8/1917 | Anderson | 206/39.5 |
| 1,451,279 | A | | 4/1923 | Strietelmeier | |
| 1,479,611 | A | * | 1/1924 | Jones | 206/0.81 |
| 1,481,182 | A | | 1/1924 | Brooks | |
| 1,670,343 | A | | 5/1928 | Clemens | |
| 1,691,872 | A | * | 11/1928 | Abraham | 150/117 |
| 1,981,975 | A | * | 11/1934 | Weimar | 150/112 |
| 2,019,035 | A | | 10/1935 | Amsterdam | |
| 2,034,398 | A | * | 3/1936 | Kash | 150/117 |
| 2,201,757 | A | * | 5/1940 | Hans | 150/117 |
| 2,252,586 | A | * | 8/1941 | Swanson | 150/136 |
| 2,429,661 | A | * | 10/1947 | Amsterdam | 150/112 |
| 2,675,042 | A | | 4/1954 | Herrera | |
| 2,727,549 | A | | 12/1955 | Knee | |

(Continued)

FOREIGN PATENT DOCUMENTS

| | | |
|---|---|---|
| CA | 2257070 | 6/2000 |

(Continued)

*Primary Examiner*—Sue A. Weaver
(74) *Attorney, Agent, or Firm*—Banner & Witcoff, Ltd.

(57) ABSTRACT

An article of manufacture with a quick access feature designed to assist users for rapidly accessing an object in an enclosed container. The access feature may be attached to a pouch, a bag, a pocket or another item designed to carry objects, including apparel that has built-in pockets or attached pockets, such as those on shirt or pants. An article of manufacture may include an access panel attached to a base member defining a pocket. The access panel includes an access opening or eyelet. A carrier member is configured for carrying an object therein and in the pocket. In one arrangement, the carrier member is movably disposed within the pocket so that the access opening exposes a portion of the carrier member for movement between a holding position and a retrieving position responsive to a force being applied via the access opening.

10 Claims, 4 Drawing Sheets

U.S. PATENT DOCUMENTS

| | | | | | |
|---|---|---|---|---|---|
| 2,893,599 | A | * | 7/1959 | Kay | 221/260 |
| 4,471,885 | A | * | 9/1984 | Mucciarone | 221/155 |
| 5,080,233 | A | | 1/1992 | Wyberg | |
| 5,443,193 | A | * | 8/1995 | Lenard | 224/666 |
| 5,713,683 | A | | 2/1998 | Bergy et al. | |
| 6,089,289 | A | | 7/2000 | Florjancic | |
| 6,155,410 | A | | 12/2000 | Davis | |

FOREIGN PATENT DOCUMENTS

| | | | | |
|---|---|---|---|---|
| DE | 3607779 | | | 10/1986 |
| GB | 2210603 | A | * | 6/1989 |
| GB | 2249475 | A | * | 5/1992 |

* cited by examiner

ARTICLE OF MANUFACTURE WITH QUICK ACCESS FEATURE

CROSS-REFERENCE TO RELATED APPLICATIONS

This present application is a continuation-in-part of U.S. application Ser. No. 10/391,958, filed on Mar. 19, 2003, now abandoned, which is a non-provisional application of U.S. Application Ser. No. 60/406,381 filed on Aug. 28, 2002, the contents therein are incorporated by references herein.

FIELD OF INVENTION

The present invention relates to article of apparel for fashions, in particular to article of apparel with a pocket having an access feature for retrieving objects.

BACKGROUND OF INVENTION

Currently designed containers, especially those for mobile phones, personal digital assistants (PDA) and similar objects, require some level of attentiveness and dexterity from the user to access the object in the container. Also, with existing container designs, users have to compromise between accessibility and security of a contained object.

Thus, there is a need to assist users in the process of accessing objects in their containers or other articles of manufacture.

SUMMARY OF INVENTION

The invention pertains to an article of manufacture with a quick access feature designed to assist users access an object in an enclosed container body.

In one aspect, a quick access feature may be attached to a pouch, a bag, a pocket or another item designed to carry objects, including apparel that has built-in pockets or attached pockets.

In one aspect, there is provided an article of manufacture including an access panel attached to a base member defining a pocket. The access panel includes an access opening or eyelet. A carrier member is configured for carrying an object and in the pocket. In one arrangement, the carrier member is movably disposed within the pocket so that the access opening exposes a portion of the carrier member for movement between a holding position and a retrieving position responsive to a force being applied via the access opening. In this way, the holding position of the carrier member holds an object in the pocket and the retrieving position allows an object to be removed from the pocket. In one aspect, the holding position is formed after release of a force at the retrieving position.

In yet another aspect, the carrier member is biased towards the holding position in response to the force. In a further aspect, the carrier member is composed of a shape recovery material.

In another one aspect, there is provided an article of manufacture including an access panel attached to a base member defining a pocket. The access panel includes an access opening or eyelet. A carrier member is configured for carrying an object therein and in the pocket. In one arrangement, the carrier member is movably disposed within the pocket so that the access opening exposes a portion of the carrier member for movement between a holding position and a retrieving position responsive to a force being applied via the access opening and a biasing member is includes for biasing the carrier member towards the holding position in response to the force.

In yet another aspect, there is provided an article of manufacture including a pocket having an opened top end and a bottom end and the pocket has a front face with an access opening therein. A carrier for retaining an object is disposed inside of the pocket. In one arrangement, the carrier has a top end stationary with the opened top end of the pocket and the carrier has a movable end configured for movement towards the opened top end of the pocket responsive to a force being applied thereto through the access opening. In one aspect, the access opening includes a geometry indicative of a linear application of the force to the movable end of the carrier. In yet another aspect, the movable end is biased towards the bottom end of the pocket in response to the force. The biasing may be provided by a biasing element configured for biasing the movable end of the carrier towards bottom end of the pocket.

In one aspect, an article of manufacture may include an access opening with a top end and a bottom end in the front face. The movable end of the carrier may be disposed at predetermined distance from the bottom end of the access opening so as to define and an insertion gap of sufficient size for insertion of a finger or other object for application of the force to the movable end of the carrier.

In another aspect, there is provided an article of manufacture includes a pocket having an elongated access eyelet for exposing an interior of the pocket. An inner pocket carrier is configured for holding and retrieving object from within. An inner pocket carrier is disposed within the pocket and has an exposed movable end via the elongated access eyelet so that the movable end travels along a length of the access eyelet responsive to a force.

DETAILED DESCRIPTION OF THE PREFERRED EMBODIMENTS

In the following description of the various embodiments, reference is made to the accompanying drawings, which form a part hereof, and in which is shown by way of illustration various embodiments in which the invention may be practiced. It is to be understood that other embodiments may be utilized and structural and functional modifications may be made without departing from the scope of the present invention.

Figure 1:
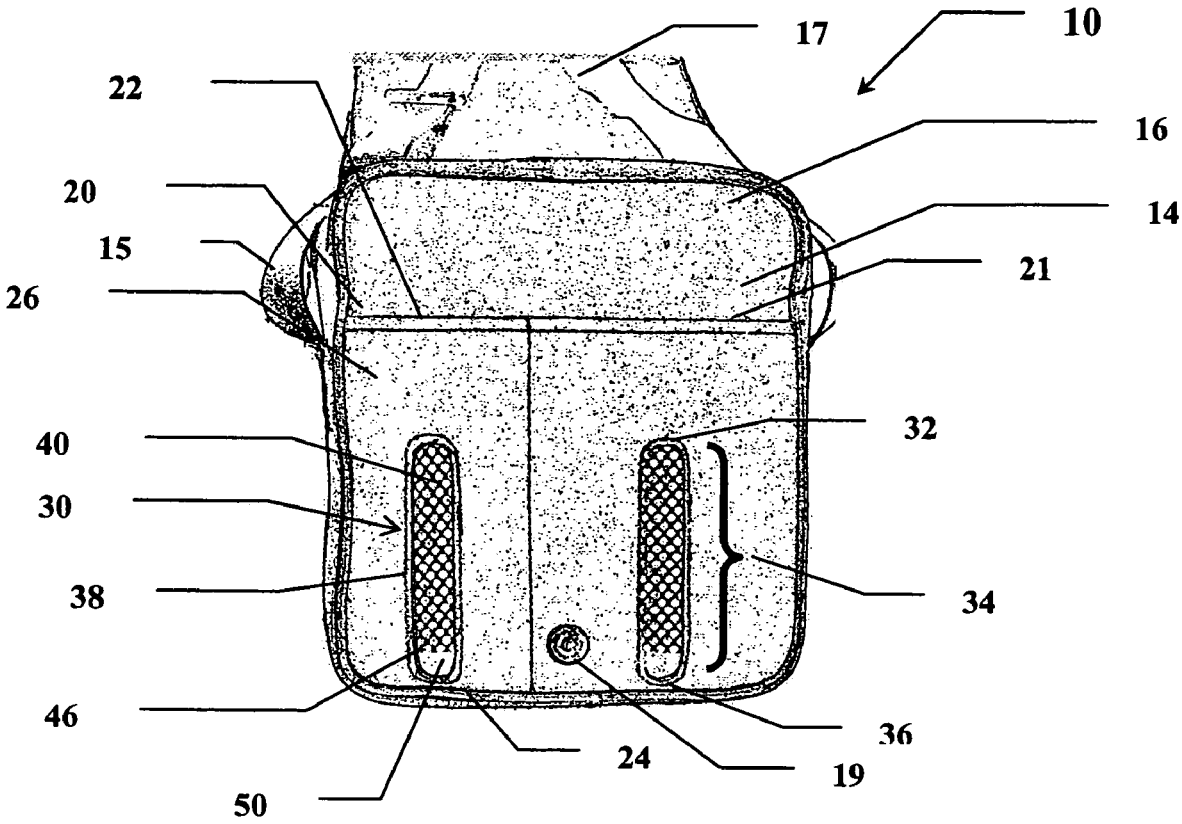
FIG. 1 illustrates a pliable carrying bag according to one or more aspects of the present invention.

FIGS. 1 and 4-7D illustrate an article of manufacture according to one or more aspects of the present invention. FIG. 1 is a partial front view of a pliable carrying bag or container 10 including two attached front pockets 20, 21 configured to carry objects inside. The front pockets 20, 21 are designed to assist users to access an object in the pockets quickly and intuitively. While two front pockets 20, 21 are shown, the inventive aspects can be practiced with one or more front pockets. There are a wide variety of implementations in which the front pockets may be incorporated into a pouch, a bag, or another item designed to carry objects. For example, the other items include apparel with built-in pockets or attached pockets such as those on shirts or pants garment, sports coat, rain coats, overcoats and the like. The bag 10 may have a carrying strap 15 for transport and top flap 17 which may mate to a fastener 19, such as a magnetic closure. The bag 10 may be made of a prefabricated material, such as hard leather, metal, hardened plastic and the like. The pocket 20, 21 allows for uninhibited accessibility, while maintaining the security of the contained objects.

Figures 2, 3:
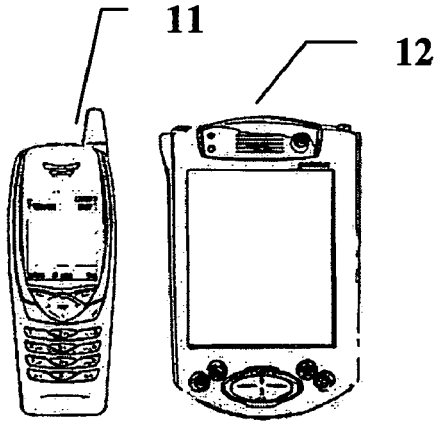
FIG. 2 illustrates an example mobile telephone which may be used with a bag shown in FIG. 1.
FIG. 3 illustrates an example Personal Digital Assistant (PDA) which may be used with a bag shown in FIG. 1.

The pockets 20, 21 comprise an opened top end 22 in which objects 11, 12 such as shown in FIGS. 2 and 3, enter and exit the pockets. The pockets 20, 21 have a closed bottom end 24 disposed opposite of the top end. Nevertheless, bottom end 24 may be opened in one arrangement. In one inventive aspect, the pockets 20, 21 include an access panel 26 having an exposed front face 27 and an interior rear face 28. The access panel 26 may be fixedly attached to a fabric base structure or base member 14, such as a face panel 16 of the container 10. Nevertheless, the fabric base structure 14 can be any appropriate type where fabric materials are used to form pockets. The access panel 26 may be sewn or otherwise bounded to the fabric base 14 using conventional manufacturing methods. The access panel 26 includes an elongated eyelet or access opening 30 configured for a user to access objects located within the pockets 20, 21.

Figure 4:
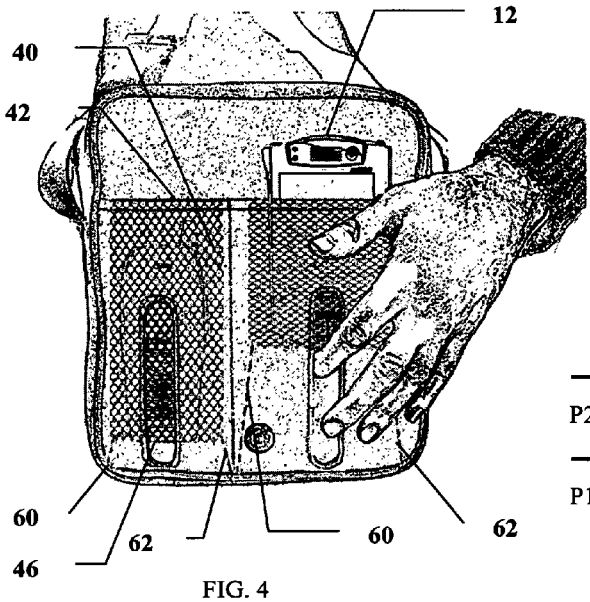
FIG. 4 illustrates a process of carrying and removing objects for the bag of FIG. 1 according to one or more aspects of the present invention.
Figure 5:
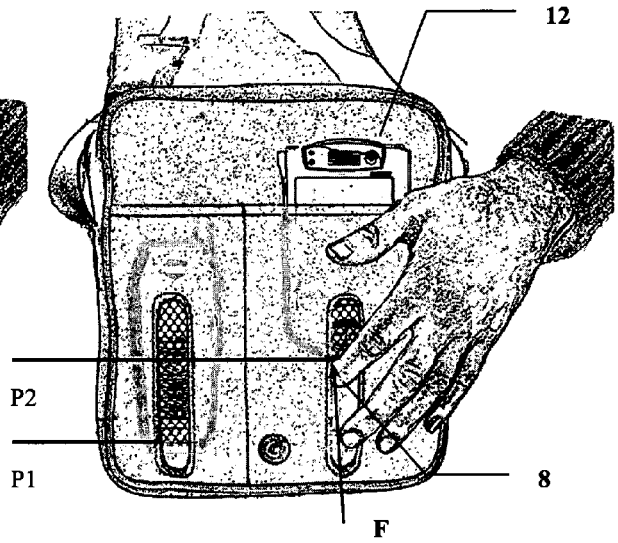
FIG. 5 illustrates a user retrieving an object via a quick access feature according to one or more aspects of the present invention.

With reference to FIGS. 1 and 4-5, in one inventive aspect, the pockets 20, 21 include an inner pocket member or carrier member 40 which is configured for holding an object, such as a mobile telephone 11 or PDA 12, in the interior of the pocket 20, 21 and an enabling retrieval of the object. In one arrangement shown in FIG. 4, the carrier member 40 is movable within the pocket 20, 21, in which the access opening 30 exposes a portion of the carrier member 40 for movement between a holding position P1 and a retrieving position P2 responsive to a manual force that is applied through the access opening 26. The carrier member 40 includes a top end 42 that may be fixedly attached to the fabric base member 14 and the access panel 26 so the object can enter the pocket 20, 21 and the interior 44 of the carrier member 40. In one arrangement, the carrier member 40 includes a moveable bottom end 46 that slides or other travels a length of the access opening 30 between the holding position P1 and the retrieving position P2. These inventive aspects are more fully illustrated in FIGS. 4 and 5.

With continued reference to FIG. 1, the access opening 30 may be arranged in a linear geometry for enabling efficient movement of the object outside of the pocket. The access opening 30 includes a top end 32 connected to a linear portion 34 and a bottom end 36 in the front face 27. To enable efficient and rapid access to the object with the pocket 20, the movable end 46 of the carrier may be disposed at predetermined distance from the bottom end 36 of the access opening 30. This predetermined distance configuration defines an insertion gap 50 of sufficient size for insertion of a finger 8 of a user or other object for application of the force to the movable end 46 of the carrier member 40. That is, a single linear sweeping motion of the user's finger 8 may move the contained object 11, 12 from the holding position P1 to the retrieving position P2.

Figure 6:
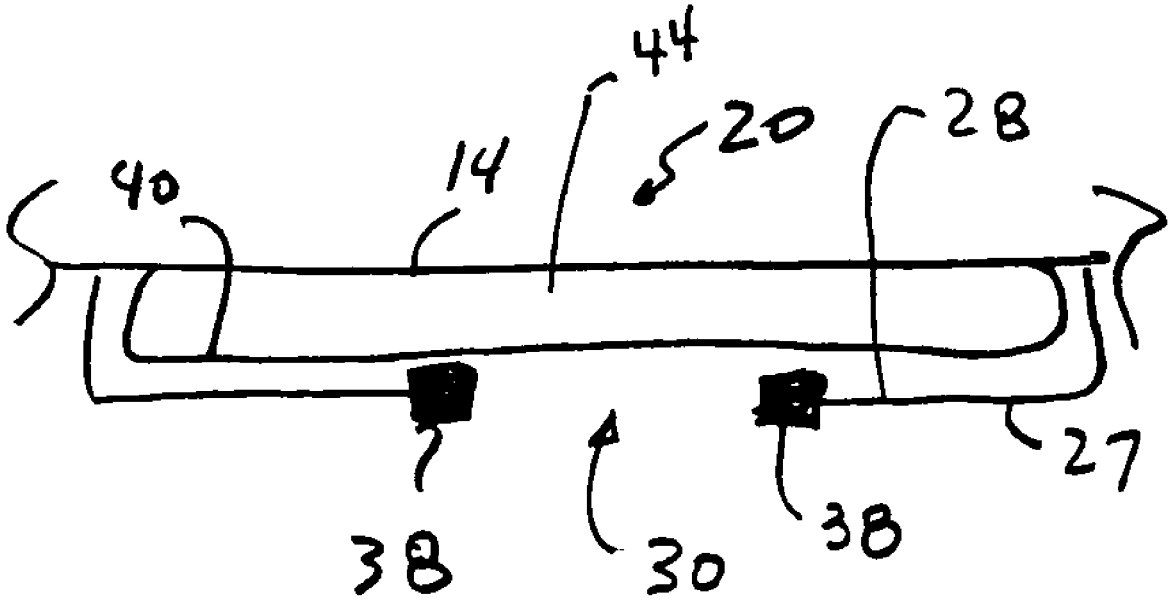
FIG. 6 illustrates an enlarged schematic representation of a section view of a pocket of the bag of FIG. 1 to show relationships of the components.
Figure 7A:
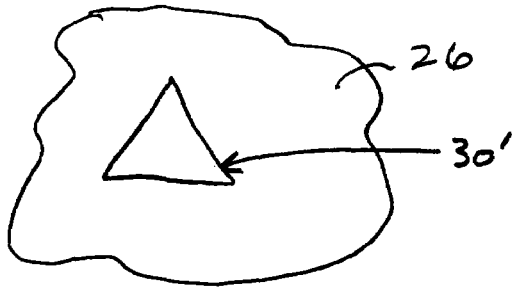
FIGS. 7A-D illustrate alternative profile shapes of an access opening according to one or more aspects of the present invention.
Figure 7B:
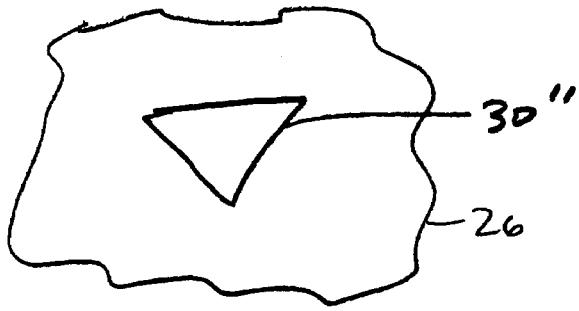
Figure 7C:
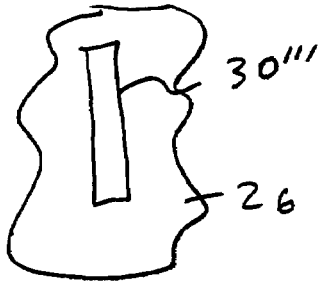
Figure 7D:
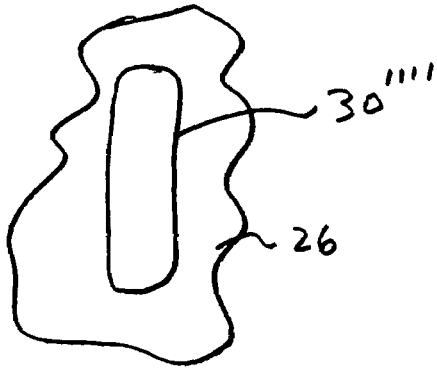

With reference to FIGS. 1 and 6, the peripheral edge of the access opening 30 may include a reinforcing element 38 made of a rigid or semi-rigid material with respect to the material of the access panel 26. The rigid material may be of a variety of material compositions, such as plastic resin, and/or metal strips. Nevertheless, the semi-rigid material that may be implemented includes leather, synthetic leather, and/or other materials. The reinforcing element 38 can be easily and economically made using a variety of economical manufacturing processes, including molding, metal stamping, hardened plastic forms and the like. Thus, a quick access feature lends itself to a variety of economical manufacturing processes using a variety of economical materials. Nevertheless, the access opening 30 may have an appropriate shape for enable access to the objects 11, 12 within the pockets 20, 21. The profile shapes of the access opening 30 may include triangular 30', 30", rectangular 30''', oval 30'''', oblong, square and the like as shown in FIGS. 7A-D.

As used herein a "shape recovery fabric" is a fabric that can be placed in tension and upon release, the fabric springs back to its original shape. In one case, a shape recovery fabric may be stretched linearly 50%-100% along a planar axis and return to its original shape. In other arrangements, a shape recovery fabric may be stretched 60%-90% and 70%-80% along a planar axis and return to the original shape. Nevertheless, other ranges are possible. In one arrangement, a shape recovery fabric may be implemented which has a blend of substantially inelastic material and elastic fibers. For example, the inelastic material may comprise cotton or leather. Nevertheless, other inelastic fibers may be implemented in the shape recovery fabric. The elastic fibers may comprise material sold under the LYCRA™ brand. LYCRA™ is a trademark of the DuPont Corporation for its brand of a family of premium elastane fiber.

The carrier member 40 may be constructed of a wide variety of materials. In one arrangement, the carrier member 40 may constructed of a resilient material preferably made from a woven sheet material. The elastic behavior may be accomplished by using woven elastic fibers. The material may be constructed from synthetic elastic fibers chiefly made from polyurethane, e.g., spandex. Suitable synthetic fibers can include LYCRA™ by the DuPont Co., CLEERSPAN™ by the Globe Manufacturing Co. or another type of commercially available spandex fiber. Nevertheless, the carrier member 40 may also include other types of fibers to achieve desired characteristics for movement or may be constructed of a shape recovery material. Alternatively, the carrier member 40 may be constructed from a range of weave and knit patterns that vary the direction of stretch. For example, an opened mesh material can stretch a longitudinal direction and enable visual communication for a user to see the object within the pocket 20, 21 by way of the access opening 30.

FIG. 4 illustrates a view of the carrying bag with a superposition of the carrier member 40 through the access panel 26. FIG. 4 also shows relative positions of a mobile phone 11 inside the pockets 20 while being carried and a PDA 12 in the process of being retrieved or otherwise being removed from the pocket 20. In one inventive aspect, the carrier member 40 includes at least one or more biasing members or elastic pieces 60, 62 for biasing or otherwise pulling the carrier member 40 towards the holding position P1 in response to a retrieving force applied by a user's finger 8 or other object (See FIG. 5). One end of the biasing member 60, 62 may be attached to movable end 46 of the carrier member 40 and the opposing end may be attached to a bottom portion of the pocket 20, 21. That is the opposing end of the biasing member 60, 62 may be connected to the base member 14 or the rear face 28 of the access panel 26. The biasing member 60, 62 may be constructed of a number of well known resilient, elastic, or spring materials.

FIG. 4 illustrates the elastic pieces 60, 62 in a resting or holding position P1 prior to a manual force F applied on the movable end 46 of the carrier member 40. In the holding position P1 (see FIG. 5) the elastic pieces 60, 62 may be slightly stretched to pull the carrier member 40 taut with respect to the top end 42 and taut within the interior of the pocket 20, 21. In a retrieving position P2, the elastic pieces 60, 62 are stretched or otherwise elongated in responsive to the force F through access opening 30. As shown in FIG. 5, a user may retrieve an object 12 via access opening 30. To retrieve an object in the pocket 60, 62, a user may insert his/her finger in the insertion gap 50 via the lower portion of the access opening 30, pushes the object 11, 12 upward toward the pocket opening 22 and thus retrieves the object. The attached elastic pieces 60, 62 returns the carrier member 40 to the original position, such as the resting or holding position, after the object has been retrieved or otherwise held by the user. It should be noted that the carrier member 40 may protect or cushion the objects 11, 12 in the pockets 20, 21 from impacts forces. Further, during a retrieval operation, the material of the carrier member 40 may enable smooth and reduced friction movement against the rear face 28 or reinforcing element 38.

Thus, an article of manufacture may have an attached feature that assists a user to access a contained object with a pocket allowing quick-draw of a contained object. In one arrangement, the attached features may include one or more long narrow eyelets 30 having sufficient size allowing a finger of user to access a contained object. A carrier member is configured for carrying an object therein and in the pocket. In one arrangement, the carrier member is movably disposed within the pocket so that the access opening exposes a portion of the carrier member for movement between a holding position and a retrieving position responsive to a force being applied via the access opening.

While the present invention has been described with reference to preferred and exemplary embodiments, it will be understood by those of ordinary skill in the art that various changes may be made and equivalents may be substituted for elements thereof without departing from the scope of the invention. In addition, many modifications may be made to adapt a particular situation or material to the teachings of the invention without departing from its scope. Therefore, it is intended that the invention not be limited to the particular embodiment disclosed, but that the invention include all embodiments falling within the scope of the appended claims.

I claim:

1. An article of manufacture, comprising:

an access panel attached to a base member for defining a pocket, and the access panel including an access opening therein; and a carrier member configured for an receiving an therein object, the carrier member being movably disposed within the pocket, in which the access opening exposes a portion of the carrier member for movement between a holding position and a retrieving position responsive to a force being applied via the access opening; wherein the carrier member comprises a fabric material, and the carrier member includes a top end being attached to the base member and the access panel, the top end being open to receive an object therein, the carrier member includes a free bottom end that moves between the holding position and the retrieving position.

2. The article of manufacture in accordance with claim 1, in which the holding position of the carrier member holds an object in the pocket and the retrieving position allows an object to be removed from the pocket, the holding position being formed after release of a force at the retrieving position.

3. The article of manufacture in accordance with claim 1, in which the carrier member is biased towards the holding position in response to the force.

4. The article of manufacture in accordance with claim 1, wherein the carrier member is composed of a shape recovery material.

5. The article of manufacture in accordance with claim 1, further comprising at least one biasing member for biasing the carrier member towards the holding position in response to the force.

6. The article of manufacture in accordance with claim 5, in which the at least one biasing member comprises a resilient material.

7. The article of manufacture in accordance with claim 5, in which the at least one biasing member is attached to the free bottom end of the carrier member.

8. The article of manufacture in accordance with claim 1, in which the access opening includes peripheral edge including at least a linear edge and a rounded edge, in which one of the linear edge and the rounded edge is rigid.

9. The article of manufacture in accordance with claim 1, in which the access opening has a length which is longer than a width.

10. The article of manufacture in accordance with claim 1, wherein the fabric material is mesh.

* * * * *